United States Patent [19]

Bond

[11] Patent Number: 4,860,816

[45] Date of Patent: Aug. 29, 1989

[54] CONTROL SYSTEM FOR VIBRATORY APPARATUS

[75] Inventor: Robert Bond, Barrington, Ill.

[73] Assignee: General Kinematics Corporation, Barrington, Ill.

[21] Appl. No.: 244,335

[22] Filed: Sep. 15, 1988

[51] Int. Cl.[4] ..... B22C 15/10

[52] U.S. Cl. ..... 164/154; 164/192; 164/203; 366/116

[58] Field of Search ..... 164/154, 192, 203, 39, 164/456; 366/116

[56] References Cited

U.S. PATENT DOCUMENTS 3,335,787 8/1967 Dietert et al. ..... 164/456 X
3,443,797 5/1969 Branson ..... 366/116

FOREIGN PATENT DOCUMENTS 54-99734 8/1979 Japan ..... 164/203
967670 10/1982 U.S.S.R. ..... 164/203
1122349 11/1984 U.S.S.R. ..... 366/116

*Primary Examiner*—Nicholas P. Godici
*Assistant Examiner*—J. Reed Batten, Jr.
*Attorney, Agent, or Firm*—Wood, Dalton, Phillips, Mason & Rowe

[57] ABSTRACT

A compaction table control system includes a variable speed vibratory motor having an eccentric weight coupled to a compaction table. The motor is operated according to acceleration of said in a flask to vary the motor speed and thus the acceleration of the sand.

13 Claims, 2 Drawing Sheets

CONTROL SYSTEM FOR VIBRATORY APPARATUS

FIELD OF THE INVENTION

This invention relates generally to a vibratory apparatus, and more particularly, to a control system therefor.

BACKGROUND OF THE INVENTION

Vibratory systems and methods for packing foundry sand into a pattern prior to the pouring of molten metal have been in use for many years. One such system and method is described in Musschoot U.S. Pat. No. 4,454,906. Such a system is used for the casting of molten metal where a pattern embedded in sand is used to determine the shape into which the molten metal is formed. To ensure that the foundry sand fully penetrates all cavities and recesses of the pattern, a mold flask containing the pattern and sand is vibrated at controlled frequencies and strokes to produce accelerations in excess of gravitational acceleration to cause the sand to penetrate and completely fill all cavities, etc., in the pattern and then the accelerations are reduced to produce an acceleration less than the acceleration due to gravity to compact the sand in place. These systems are commonly referred to as lost foam integrated compaction systems.

Such known systems provided acceleration as by vibrating a vibratory table on which the mold flask is supported. Certain systems utilize a manual control to vary the speed of the motor to control acceleration. Alternatively, systems have been used which sense acceleration of the vibratory table and automatically control acceleration by controlling the speed of the motor responsive thereto.

It has been proposed that prior control systems do not provide adequate control, particularly in applications where the flask is loosely supported on the table. This results because acceleration of the vibratory bed may be different from the acceleration of the flask itself. Even in applications in which the flask is secured to the bed, the control may be less than ideal. Particularly, in such a system the critical element to be controlled is the sand, rather than flask. The vibratory table is merely a reference point. Although movement of the table is related to sand movement, it is not wholly accurate.

The present invention is intended to overcoming these and other problems associated with the prior control systems.

SUMMARY OF THE INVENTION

In accordance with the present invention, a control system is provided whereby the vibratory apparatus for packing foundry sand is controlled according to a characteristic related to movement of the sand.

Broadly, there is disclosed herein a control system for a vibratory apparatus including a table, exciter means in operative relationship with the table for imparting a vibratory force thereto and comprising a motor, means for supporting a mold flask on the table, and a control comprising means for sensing a characteristic related to movement of sand in the flask, means for setting a desired operating condition of the vibratory apparatus, and control means coupled to the sensing means, the setting means, and the motor for controlling the motor to controllably vary sand movement responsive to the sensed operating characteristic and the desired operating condition to maintain the vibratory apparatus at the desired operating condition.

Specifically, a mold flask is provided with a pattern suspended therein by a suspension means. The flask is supported on a vibratory table. A variable speed motor having an eccentric counterweight connected thereto is coupled to the table for imparting a vibratory force on the table responsive to rotation of the motor and the counterweight. The vibratory force is variable responsive to variation of speed of the motor. A sensing device is provided for sensing movement of sand in the flask. Set point means are provided for setting a desired movement parameter value. A programmable control device is electrically connected to the sensor, the set point setting device, and the motor. The control device stores a program which is operable to controllably vary the speed of the motor responsive to the sensed movement and the desired movement to maintain the acceleration of sand at the desired level.

According to one embodiment of the invention, the sensing device comprises an accelerometer.

According to another embodiment of the invention, means are included for sensing speed of the motor, and the control device selectively controls the motor speed responsive to actual motor speed or actual acceleration.

According to a further embodiment of the invention, the programmable control device includes a program for controlling multiple zones of operation, each said zone of operation being defined by length of time, or the amount of sand to be filled in the flask. Thus, within each zone the motor can be controlled to provide for compaction of the sand or fluidization of the sand, as necessary, or desired.

Further features and advantages of the invention will readily be apparent from the specification and the drawings.

DETAILED DESCRIPTION OF THE PREFERRED EMBODIMENT

Figure 1:
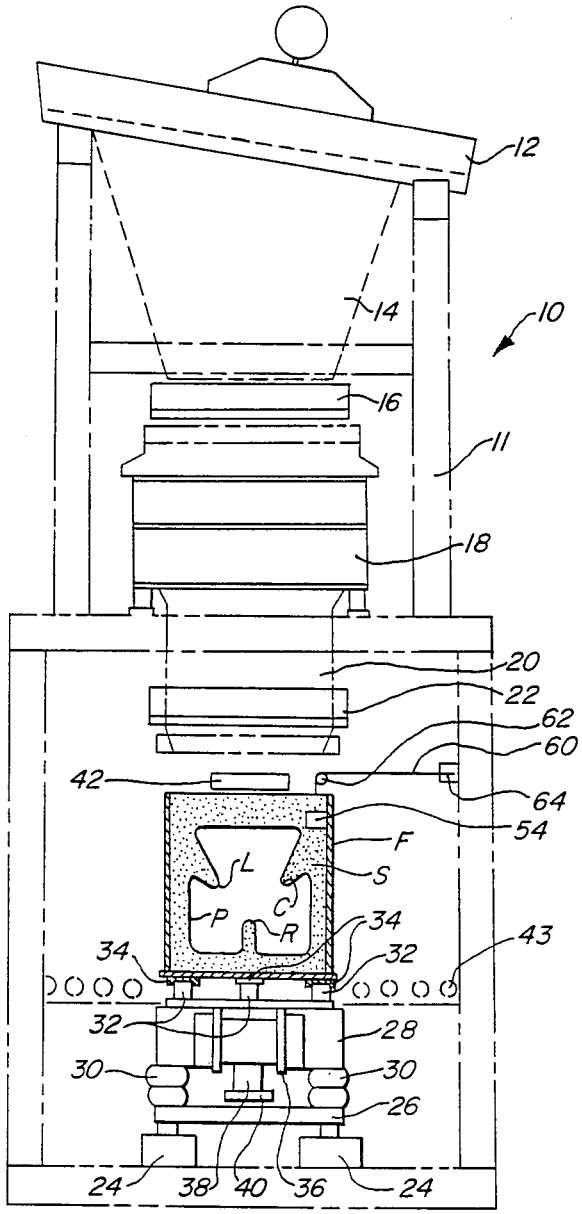
FIG. 1 is a perspective, partially sectional view, of a lost foam integrated compaction system including a control system according to the present invention.

Referring to FIG. 1 of the drawings, there is shown a lost foam integrated compaction system apparatus 10, according to the invention, for packing foundry sand around pattern prior to the pouring of molten metal.

The apparatus 10 is mounted on a frame 11 and includes a sand screener device 12 mounted thereto which receives sand from any conventional source and maintains desired grain size distribution and removes undesirably fine sand for use in the apparatus 10. Sand flows from the screen 12 into a first hopper 14 which is superjacent a shutoff gate 16. The shutoff gate 16 may be, for example, pneumatically operated to permit system shutdown without unloading of sand from the hopper 14.

With the shutoff gate 16 opened, the sand passes downwardly through a sand cooler 18. The sand cooler 18 sense inlet temperature and automatically cools the sand to an ideal molding temperature. Subsequently, the sand drops into a second hopper 20 and thereafter through a sand valve 22. The sand valve 22 is a control and distribution unit which uniformly rains sand into a flask F supported therebelow. The gentle rain pattern of the sand eliminates any distortion of fragile patterns P in the flask F. Mounted at the bottom of the frame 11 are load cells 24. Bearing on the load cells 24 is a base 26. A vibratory table 28 is suspended above the base 26 by springs 30. The load cells 24 are of conventional construction and sense the weight on the base 26, and thus the table 28.

Extending upwardly from the table 28 are three pedestals 32 mounted in a triangular configuration. The pedestals 32 fit within recesses which are provided in downwardly opening cup-shaped retainers 34 secured to the bottom of the flask F. Thus, the flask F is loosely supported on the table 28 with the pedestals 32 each extending into a respective one of the retainers 34.

A vibration generator, or exciter, 36 in the form of an electric motor 38 having a shaft carrying an eccentric weight 40 is suspended from the bottom of the table 28 in order to produce vibrations. The motor 38 is preferably an AC squirrel cage-type motor, the speed of which is varied by varying the frequency of the voltage applied thereto. Accordingly, varying the speed of the motor 38 in combination with the eccentric weight 40 provides a varying stroke on the table 28 to vibrate a flask F which is supported on the table 28, as discussed above.

When the motor 38 is energized, it produces a vibratory force which is imparted through the table 28 and pedestals 32 to the flask F and its contents. The force is in excess of the acceleration due to gravity. The acceleration in G's is defined by the equation:

$$A = K(f)^2 S,$$

where S is the amplitude of the stroke and F is the frequency of the stroke. K is a constant dependent, in part, on the weight of the table 28 and the flask supported thereon.

The flask F houses a pattern P suspended therein by a gripper means 42. The gripper means is pneumatically operated and relaxes its grip on the pattern P as the compaction cycle progresses. While the pattern P may be of any conventional material, the invention is particularly useful when dealing with complex patterns which, by their very complexity, cannot be removed from the mold box and sand prior to the pouring of the molten metal. Rather, these complex patterns are made of materials which glassify when contacted by the molten metal, such as polyurethane foam and polystyrene plastic.

The complexities of the pattern P are schematically illustrated in the drawings by the cavities C and the recess R which may be a dead-end passage in the pattern P.

In addition to the above, a conveyor system 43 may be used to automatically advance a flask F to the apparatus 10. Particularly, a flask F advances to a position within the frame 11 and proximate the table 28. Although not shown, the table 28 may be movable upwardly and downwardly. Specifically, sensing means may be provided for determining when a flask is in position and thereafter causing the table 28 to move upwardly until the pedestals 32 are received within the retainers 34 to support the flask F thereon above the conveyor 43.

Figure 2:
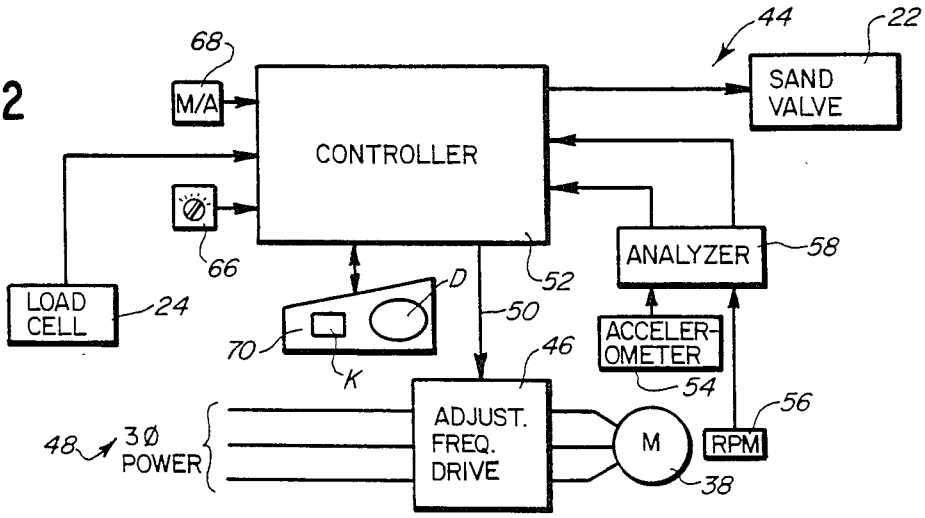
FIG. 2 is a block diagram illustrating the control system of FIG. 1.

Referring to FIG. 2, a block diagram illustrates a control system 44 for the apparatus 10 of FIG. 1. The control system 44 comprises an adjustable frequency drive 46 for providing three phase variable frequency power to the motor 38 from a source 48 of three-phase power. Frequency of power applied to the motor 38 is determined according to a frequency command signal received on a line 50 from a controller 52. The drive 46 may be, for example, a VEE-ARC PWM 8050 adjustable frequency drive. The controller 52 is preferrably a programmable controller device, such as, for example, an Allen-Bradley PLC programmable controller which stores a control program for automatically operating the apparatus 10 responsive to various input signals.

The controller 52 is also coupled to the load cells 24 and receives an analog input signal therefrom representing the weight sensed thereby. Particularly, the load cells are used to measure the weight of the sand S added to the flask F, which weight also relates to the level of the sand S within the flask F. An accelerometer 54 and a speed transducer 56 are coupled to the controller 52 through an analyzer 58. Referring also to FIG. 1, the accelerometer 54 is a conventional accelerometer which is suspended by a cable 60 over a pulley 62. The opposite end of the cable is secured within a housing 64. Thus, the accelerometer 54 senses the acceleration of movement of sand S within the flask F. Alternatively, the housing 64 may include a motorized mechanism for extracting the sensor 54 from the flask F as the level of sand S increases within the flask F.

The accelerometer 54 could be of any known construction. Alternatively, the accelerometer could be a pressure transducer which senses varying pressure caused by the sand responsive to the vibratory movement, or even an acoustic sensor which senses sound produced by movement of the sand, which sound level is related to the magnitude of the vibratory movement.

The sensor 54 generates a signal which may be, for example, an analog signal which varies over a preselected range, e.g., 0 to 5 volts, according to the sensed acceleration.

The transducer 56 may be, for example, a tachometer which senses the number of revolutions per minute of the shaft of the motor 38. The analyzer 58 may be, for example, an analyzer as manufactured by Comp-Pak which provides suitable signal levels for transmission to the controller 52.

The controller 52 also controls the position of the sand valve 22 by providing an analog signal proportional to the desired rate of sand fill. The control system 44 includes a user settable device 66 for setting a desired operation condition, such as acceleration. Also, a manual/auto switch 68 is provided for determining whether the controller controls the motor speed, and thus acceleration, responsive to the user set point device 66, or according to the control program.

An operator's panel 70 is coupled to the controller 52 which is used to set up the automatic modes of operation of the controller 52 through a system of prompts using a keyboard K with a display D. During the setup procedure, the system asks an operator to input various parameters for operation of the system. Particularly, the system control is defined by a plurality of zones of control. Each zone is determined by a time period or an amount of sand to be filled. This allows for the control scheme to vary at different times during a filling cycle. Such a control is particularly useful with a pattern P of a complex nature, as shown.

Figure 3:
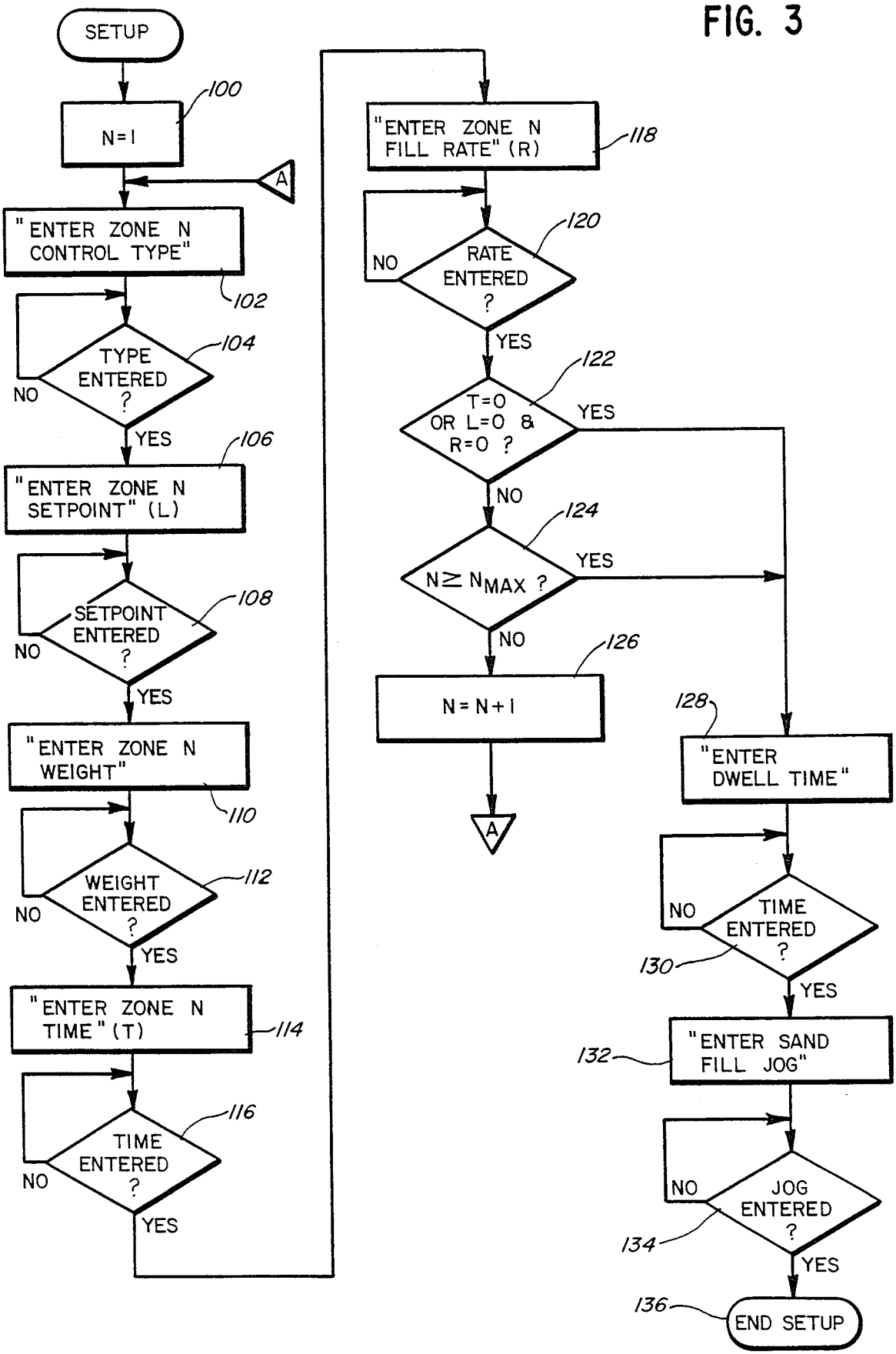
FIG. 3 is a flow diagram illustrating a setup operation program for the controller of FIG. 2.

Referring to FIG. 3, a flow diagram illustrates the operation of a setup program for predetermining the parameters for each zone in a flask filling operation.

The setup program begins at a block 100 which sets a register N equal to the value one. The value in the register N represents the zone number. At a block 102, an operator is prompted with a message on the terminal display D to "Enter zone N control type", the letter "N" being replaced by the zone number. Therefore, in the first pass through the program, the letter N will be replaced with the number 1. Responsive thereto, the operator selects the type of control required for zone 1 by entering the appropriate response using the keyboard K. The control type could be, for example, acceleration control or speed control, as discussed more specifically below. A decision block 104 then waits for the operator to enter information to select the control type.

Once the control type is entered, then the operator is prompted at a block 106 to enter a set point level L for the particular zone. The control waits at a decision block 108 for the operator to enter the set point. The set point represents the desired operational value according to the control type selected above. Specifically, if acceleration control is requested, then the operator enters an acceleration set point. Responsive thereto, in operation the controller 52 compares the actual acceleration sensed by the accelerometer 54 with the desired acceleration determined by the set point. The motor speed command signal on the line 50 is adjusted accordingly to vary the speed of the motor 38 to control acceleration, as is well known. Alternatively, if speed control is selected, then the controller 52 compares the actual speed determined by the transducer 56 with the entered speed set point and controls the speed command on the line 50 responsive thereto to maintain the motor 38 at the desired speed.

As discussed above, the duration of each zone is defined by time or level, i.e., amount of sand to be filled. At a block 110, the operator is prompted to enter the weight value of the amount of sand to be added for the particular zone. A decision block 112 waits for the value to be entered. Specifically, the operator can enter a specific weight value, the number zero to indicate that no sand is to be added, or the operator can bypass this parameter by, for example, pressing a "return" key to indicate that control within the zone is not related to weight.

At a block 114, the operator is prompted to enter length of time T for the particular zone. A decision block 116 waits for a time value to be entered. As with weight, the operator can enter a specific time, the number zero, or can bypass this parameter if time is not to be used.

At a block 118 the operator is prompted to enter a fill rate R for the particular zone. The fill rate determines the amount which the sand valve 22 is opened to admit passage of sand into the flask F. The decision block 120 waits for a value to be entered. Again, the operator can enter a specific value, the number zero, or can bypass the selection if the zone is to be operated according to time.

The program is preferably configured to permit a maximum number of zones in the automatic operating cycle. For example, the control may permit up to six zones. The number of zones actually required is dependent in part upon the complexity of the pattern P. If the operation requires less than the maximum number of zones, then the operator enters the number zero for the time length T or for both the set level L and the sand fill rate R in the first unused zone. Once all the parameters have been entered, then a decision block 122 determines if the value zero is entered for either time, or both the set point and the rate. If not, additional zone information could be entered, and a decision block 124 determines if the zone number N is greater then or equal to the maximum allowable number, i.e. six, in the illustrated example. If not, then at a block 126 the register N is incremented by one and control returns to the block 102 to permit entry of the control parameters for the next zone.

If all of the zone information has been entered as determined at either the decision block 122 or the decision block 124, then the operator is prompted at a block 128 to enter a dwell time. The dwell time is provided to permit the operator to manually vibrate the table by using the setting device 66 before the flask F is carried away on the conveying system 43. A decision block 130 waits for the dwell time to be entered. Subsequently, at a block 132 the operator is prompted to enter a sand-fill jog value. The sand-fill jog permits the operator to manually add additional sand while the flask F is still in position. At a decision block 134 control waits for the value to be entered. Subsequently, the setup routine ends at a block 136.

The form of control operation is determined according to the position of the manual/auto selector device 68. When the manual mode is selected, then the operator controls speed of the motor 37 by varying the position of the knob 66. Also, sand is entered using a similar knob (not shown) to controllably vary the opening of the sand valve 22. In such control, the operator is provided with conventional display information to indicate status of the various parameters being sensed.

If the automatic mode is selected using the selector device 68, then the controller 52 operates according to parameters defined using the setup program, discussed above. The particular form of the program again is dependent on the type of pattern to be used. An exemplary sequence is discussed herein which may be used, for example, with a pattern such as a pattern P illustrated in FIG. 1.

In the example, the setup program is used to configure operation of the system according to the following parameters:

| | | |
|---|---|---|
| Zone 1 | Control Type: | Acceleration |
| | Set Point: | 1.0 G. |
| | Sand Fill Rate: | 100 pounds per second |
| | Weight: | 1,500 pounds |
| Zone 2 | Control Type: | Acceleration |
| | Set Point: | 4.0 G's |
| | Sand Fill Rate: | 0 pounds per second |
| | Time: | 30 seconds |
| Zone 3 | Control Type: | Acceleration |
| | Set Point: | 3.5 G's |
| | Sand Fill Rate: | 20 pounds per second |
| | Weight: | 1,000 pounds |
| Zone 4 | Control Type: | Acceleration |
| | Set Point: | 2.0 G's |
| | Sand Fill Rate: | 0 pounds per second |
| Time: | 20 seconds | |
| | End Dwell Time: | 10 seconds |
| | Sand Fill Jog: | 20 pounds per second |

With a flask F in position, and the controller 52 configured with the above parameters, the compaction sequence begins. Specifically, the motor 38 is brought up to a speed to provide 1.0 G acceleration as sensed by the accelerometer 54 and this level is maintained during the first zone of operation. Also, the sand fill valve 22 is opened to provide a flow rate of 100 pounds per second. This control action continues until the total weight of sand added to the flask is 1,500 pounds, as determined by the load cells 24. As the sand fills up in the flask, the acceleration causes the sand to compact so as to minimize air pockets to provide a rigid support for the pattern P. However, because of gravitational forces, the sand S will not move upwardly to fill the recess R.

Once 1,500 pounds of sand have been added, the control advances to the zone 2 operation. In the zone 2 operation, the sand valve 22 is closed and the motor 38 is operated to provide 4.0 G's of acceleration. At such acceleration, the sand becomes fluidized so that it fills the recess R, or any other such cavities according to the particular pattern P. This operation continues for 30 seconds. At the end of 30 seconds, the zone 3 control begins and the sand valve 22 is again opened to provide a fill rate of 20 pounds per second. Also, the controller 52 lowers the acceleration to a rate of 3.5 G's, until 1,000 pounds of additional sand have been added. At the end of the zone 3 cycle, the flask F should be substantially full of sand.

During zone 4 operation, the motor 38 is operated to provide 2 G's of acceleration for 20 seconds. This is done to provide final compaction of the sand. Thereafter, the motor 38 is de-energized and the operator has the option to add additional sand using a sand fill job pushbutton or vibrate the table using a table job pushbutton, as necessary, or desired. This can be used, for example, if compaction during the zone 4 control lowers the level of sand S in the flak F, or if additional compaction is required.

Thus, the invention comprehends a control system for a compaction table to selectively control the speed of a motor according to sensed acceleration of the sand in a flask.

I claim:

1. In a vibratory apparatus including a table having means for supporting a flask into which is supplied a pattern and sand, and exciter means in operative relation with the table for imparting a vibratory force thereto to move sand in the flask, a control system comprising:

means for setting a desired rate of acceleration of vibratory movement of sand in a flask supported on the table;

means for sensing actual rate of acceleration of vibratory movement of sand in the flask; and means for mounting the sensing means on the apparatus in a manner that the sensing means is above the table and is extendable within the periphery of the flask control means coupled to said exciter means, said setting means, and said sensing means for controlling said exciter means responsive to the desired rate of acceleration and the actual rate of acceleration to control movement of the sand.

2. The vibratory apparatus of claim 1 wherein said sensing means comprises an accelerometer.

3. The vibratory apparatus of claim 1 wherein said exciter means comprises a motor having an eccentric counterweight mounted thereon.

4. The vibratory apparatus of claim 3 wherein said motor comprises a variable speed motor and said control means is operable to vary the speed of the motor to controllably vary the vibratory force.

5. In a vibratory apparatus including a table, exciter means in operative relation with the table for imparting a vibratory force thereto and comprising a motor and a rotatable eccentric counterweight connected to the motor to be rotated thereby, and means for supporting a flask on said table, the flask, in use, holding a pattern to be packed by sand filled in the flask, a control system comprising:

set point means for setting a desired rate of acceleration of movement of sand in a flask supported on the table;

sensing means for sensing actual rate of acceleration of vibratory movement of sand in the flask; and means for mounting the sensing means on the apparatus in a manner that the sensing means is above the table and is extendable within the periphery of the flask control means coupled to said motor, said set point means, and said sensing means for controlling said motor responsive to the sensed rate of acceleration relative to the desired rate of acceleration to control movement of the sand to provide compaction of sand about a pattern.

6. The vibratory apparatus of claim 5 wherein said sensing means comprises an accelerometer.

7. The vibratory apparatus of claim 5 wherein said set point means comprises a programmed controller storing a program for automatically determining the desired rate of acceleration.

8. The vibratory apparatus of claim 5 wherein said motor comprises a variable speed motor and said control means is operable to vary the speed of the motor to controllably vary the vibratory force.

9. A vibratory apparatus comprising:

a table;

exciter means in operative relation with the table for imparting a vibratory force thereto and comprising a motor and a rotatable eccentric counterweight connected to the motor to be rotated thereby;

means for supporting a flask on said table, the flask, in use, holding a pattern to be packed by sand filled in the flask, sensing means for directly sensing movement of sand in a flask supported on said table;

means for mounting the sensing means on the apparatus in a manner that the sensing means is above the table and is extendable within the periphery of the flask set point means for setting a desired rate of movement of said sand;

control means coupled to said sensing means and said set point means for developing an exciter command necessary to maintain the movement of sand at the desired rate; and drive means coupled to said control means and said exciter means and responsive to the exciter command for operating said motor and counterweight to produce a vibratory force necessary to satisfy the desired rate of sand movement.

10. The vibratory apparatus of claim 9 wherein said sensing means comprises an accelerometer.

11. The vibratory apparatus of claim 9 wherein said set point means comprises a programmed controller storing a program for automatically determining the desired rate of movement.

12. The vibratory apparatus of claim 9 wherein said motor comprises a variable speed motor and said control means is operable to vary the speed of the motor to controllably vary the vibratory force.

13. The vibratory apparatus of claim 9 further comprising means coupled to said control means for sensing motor speed and wherein said control means selectively develops the exciter command responsive to either said motor speed or the movement of the sand.

* * * * *

UNITED STATES PATENT AND TRADEMARK OFFICE

CERTIFICATE OF CORRECTION

PATENT NO. : 4,860,816

DATED : August 29, 1989

INVENTOR(S) : ROBERT BOND

It is certified that error appears in the above-identified patent and that said Letters Patent is hereby corrected as shown below:

Column 2, line 66, after "18", cancel "sense" and substitute therefor --senses--.

Column 5, line 2, after "for" cancel "predetermining" and substitute therefor --predefining--.

Column 6, line 31, after "motor" cancel "37" and substitute therefor --38--.

Column 7, line 30, after "fill" cancel "job" and substitute therefor --jog--;
line 31, after "table: cancel "job" and substitute therefor --jog--;
line 34, before "F" cancel "flak" and substitute therefor --flask--;

Signed and Sealed this

Twenty-second Day of January, 1991

*Attest:*

HARRY F. MANBECK, JR.

*Attesting Officer*

*Commissioner of Patents and Trademarks*